US009416951B1

(12) United States Patent
Householder

(10) Patent No.: US 9,416,951 B1
(45) Date of Patent: Aug. 16, 2016

(54) COMPACT INDIRECT LIGHTING SYSTEM WITH IMPROVED THERMAL PERFORMANCE

(71) Applicant: Universal Lighting Technologies, Inc., Madison, AL (US)

(72) Inventor: John R. Householder, Cedar Park, TX (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/472,100

(22) Filed: Aug. 28, 2014

(51) Int. Cl.

| | |
|---|---|
| ***F21V 29/00*** | (2015.01) |
| ***F21V 7/22*** | (2006.01) |
| ***F21V 5/04*** | (2006.01) |
| *F21Y 101/02* | (2006.01) |

(52) U.S. Cl.
CPC ..... *F21V 29/004* (2013.01); *F21V 5/048* (2013.01); *F21V 7/22* (2013.01); *F21Y 2101/02* (2013.01)

(58) Field of Classification Search
CPC ..... F21V 5/00–5/08; F21V 29/504; F21V 29/505
See application file for complete search history.

(56) References Cited

U.S. PATENT DOCUMENTS

| | | | | |
|---|---|---|---|---|
| 7,438,454 | B2 * | 10/2008 | Chinniah | B60Q 1/2696 362/500 |
| 8,016,443 | B2 | 9/2011 | Falicoff et al. | |
| 2006/0209541 | A1 * | 9/2006 | Peck | F21V 7/0091 362/247 |
| 2010/0110676 | A1 | 5/2010 | Falicoff et al. | |
| 2010/0181889 | A1 | 7/2010 | Falicoff et al. | |
| 2012/0224367 | A1 * | 9/2012 | Ariyoshi | G02B 19/0028 362/235 |
| 2014/0049951 | A1 * | 2/2014 | Ariyoshi | F21V 13/04 362/184 |

FOREIGN PATENT DOCUMENTS

| | | | |
|---|---|---|---|
| CN | 203010326 U | * | 6/2013 |
| JP | 2009009926 A | * | 1/2009 |

* cited by examiner

*Primary Examiner* — Mariceli Santiago
(74) *Attorney, Agent, or Firm* — Patterson Intellectual Property Law, P.C.; Mark J. Patterson; Jerry Turner Sewell

(57) ABSTRACT

A lighting apparatus includes a light source. A primary optical surface is configured to receive and redirect light from the light source. A secondary optical surface is configured to receive redirected light from the primary optical surface and further redirect the light in a primary emission direction. The apparatus includes a central opening through the apparatus, the central opening defining a convective path through the apparatus. A thermally conductive cover is placed over the central opening and is positioned in the convective path. The primary optical surface is positioned such that a direct view of the light source is obstructed when the apparatus is viewed from the primary emission direction. The primary and secondary optical surfaces are substantially symmetric about the central opening.

19 Claims, 11 Drawing Sheets

COMPACT INDIRECT LIGHTING SYSTEM WITH IMPROVED THERMAL PERFORMANCE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to lighting systems and optical lens devices for distributing light from a light source to a specified area. More particularly, this invention pertains to an indirect area lighting system having improved thermal performance.

Conventional lighting systems typically offer optical efficiencies of between 50 to 80%. In other words, only 50 to 80% of the light being emitted from the light source would exit the lighting system. Higher efficiency indirect lighting systems typically result in reduced "lit appearance" uniformity. To combat this problem, conventional volume lighting systems typically include a combination of indirect and direct lighting. However, direct lighting allows the viewer of the lighting system to directly see the light source which is generally undesirable as the brightness of the direct lighting can be distracting.

Lighting fixtures and systems typically must include some means for dissipating heat that is generated by the light source and related components. Conventional solutions for the thermal dissipation of heat from indirect lighting systems include heat spreaders located generally on the front of the lighting system facing the viewer. A direct view of the heat spreader may produce an undesirable aesthetic appearance for the lighting system.

What is needed, then, are indirect lighting systems using components and methods providing improved thermal performance.

BRIEF SUMMARY OF THE INVENTION

The present invention generally relates to a compact indirect lighting system with improved thermal performance.

One aspect of the present invention is a lighting apparatus including a light source. The light source emits light toward a primary optical surface. The primary optical surface is configured to receive and redirect light emitted by the light source. A secondary optical surface is configured to receive redirected light from the primary optical surface and further redirect the light in a primary emission direction. The lighting apparatus can include a central opening extending through the apparatus. The central opening can define a convective path through the apparatus.

In some embodiments, a thermally conductive cover can be placed over the central opening such that the thermally conductive cover is positioned in the convective path. The thermally conductive cover can include at least one through-hole overlapping the central opening such that air in the convective path can pass through the thermally conductive cover. Such a configuration can help improve the thermal performance of the lighting apparatus. In some embodiments, the thermally conductive cover can be a heat spreader having one or more through-holes. The through-holes can be substantially aligned with the convective path such that air can flow through the heat spreader.

In some embodiments, the apparatus includes a lens body, the primary and secondary optical surfaces being located on the lens body. The lighting apparatus can be manufactured by revolving a uniform cross-section, or the uniform cross-section can be extruded to form an elongated apparatus. In some embodiments, the primary and secondary optical surfaces can be substantially symmetric about the central opening.

One object of the present invention is to provide an efficient indirect lighting system.

Another object of the present invention is to provide a lighting system with improved thermal performance.

Another object of the present invention is to provide a lighting system with a desirable aesthetic appearance.

DETAILED DESCRIPTION OF THE INVENTION

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

Figure 1:
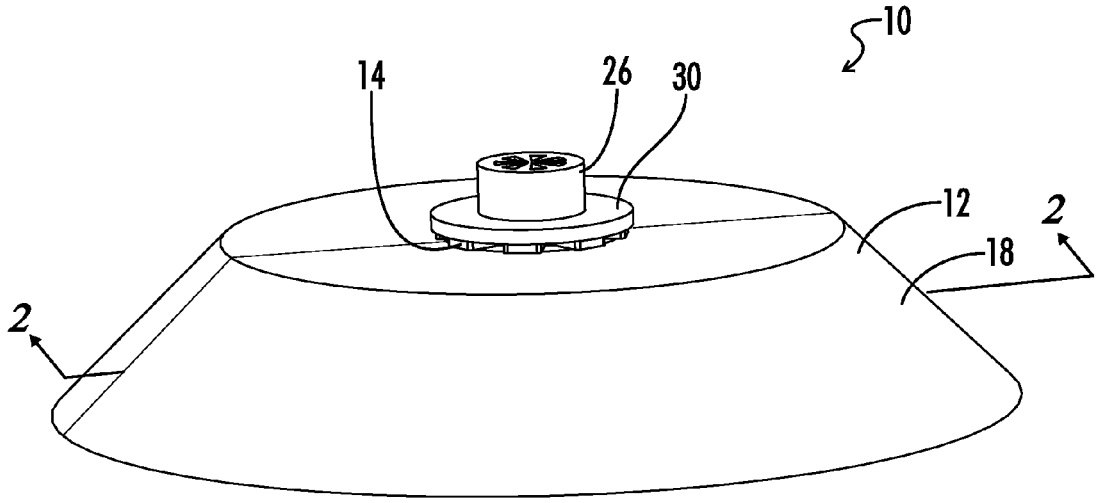
FIG. 1 is a perspective view of an embodiment of a lighting apparatus according to the present invention.
Figure 2:
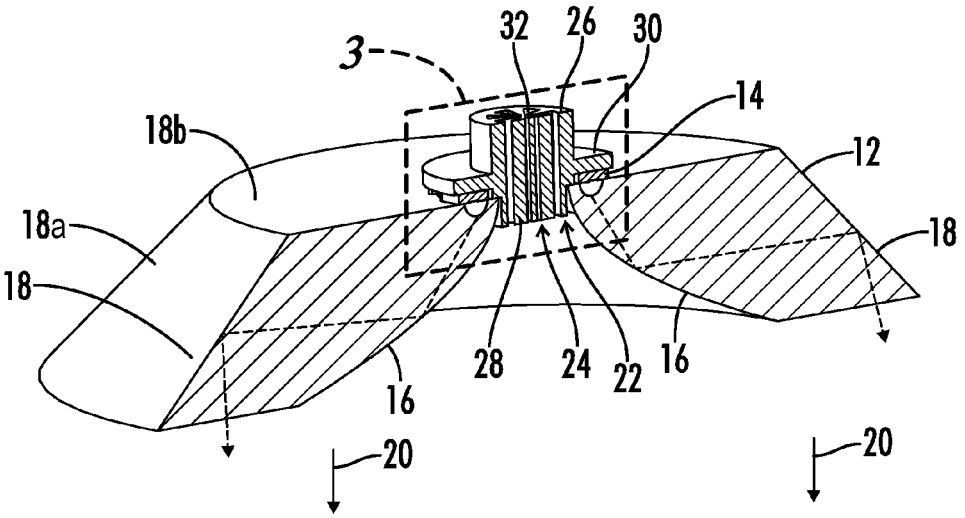
FIG. 2 is a perspective cross-sectional view of the lighting apparatus of FIG. 1.

A perspective view of a first embodiment of a lighting apparatus 10 according to aspects of the present invention is shown in FIG. 1. A perspective cross-sectional view of the lighting apparatus 10 of FIG. 1 is shown in FIG. 2. The lighting apparatus 10 can include a lens body 12 having multiple optical surfaces and a light source 14. A primary optical surface 16 can be located on the lens body 12, and configured to receive and subsequently redirect light emitted from the light source 14. A secondary optical surface 18 can also be located on the lens body 12. The secondary optical surface 18 can be configured to receive redirected light from the primary optical surface 16. The secondary optical surface can then further redirect the light in a primary emission direction 20. In some embodiments, secondary optical surface can have a first portion 18*a* and a second portion 18*b*. In some embodiments, the first and second portions 18*a* and 18*b* can be substantially planar. In other embodiments, one or more of the first and second portions 18*a* and 18*b* can be curved or rounded.

The lighting apparatus 10 can include a central opening 22. In the embodiment of FIG. 1, the central opening 22 is defined in and extends through the lens body 12. The central opening 22 can define a convective path 24 through the apparatus 10. The convective path 24 can allow air to flow through the apparatus 10, which can help increase thermal convection between the apparatus 10 and the ambient air. In some embodiments, the central opening 22 can be defined in a portion of the primary optical surface 16, the secondary optical surface 18, or both.

In some embodiments, as shown in FIG. 2, the lighting apparatus 10 can further include a thermally conductive cover 26. The thermally conductive cover 26 can include at least through-hole 32 overlapping the central opening 22. The thermally conductive cover 26 can be made of a material with a generally high thermal conductivity, including but not limited to, aluminum alloys, copper, diamond, steel, carbon, graphite, or other composite materials. The thermally conductive cover 26 in some embodiments may be formed of a material having a thermal conductivity of at least 25 watts per meter kelvin. In other embodiments, the thermally conductive cover 26 may be formed of a material having a thermal conductivity of at least 100 watts per meter kelvin. In some embodiments, the thermally conductive cover can be a thermally conductive sheet, a heat sink, or a heat spreader. The thermally conductive cover 26 will hereinafter be referred to as a heat spreader.

The heat spreader 26 can be in physical contact with the light source 14. In other embodiments, the heat spreader 26 can be in physical contact with the lens body 12, including either the primary optical surface 16 or the secondary optical surface 18, or both. In still other embodiments, the heat spreader 26 can be in physical contact with both the light source 14 and the lens body 12. The heat spreader 26 having enhanced thermal conductive properties can help heat generated by the light source 14 and retained by the lighting apparatus 10 to dissipate to the heat spreader 26 through conduction. The heat spreader 26 can help produce an increased temperature differential with the ambient air such that air readily moves along the convective path. The heat spreader 26 can then transfer the heat to the ambient air through both convection and radiation. As such, the thermal performance of the lighting apparatus 10 over an extended period of time can be enhanced by the use of the thermally conductive heat spreader 26.

Figure 3:
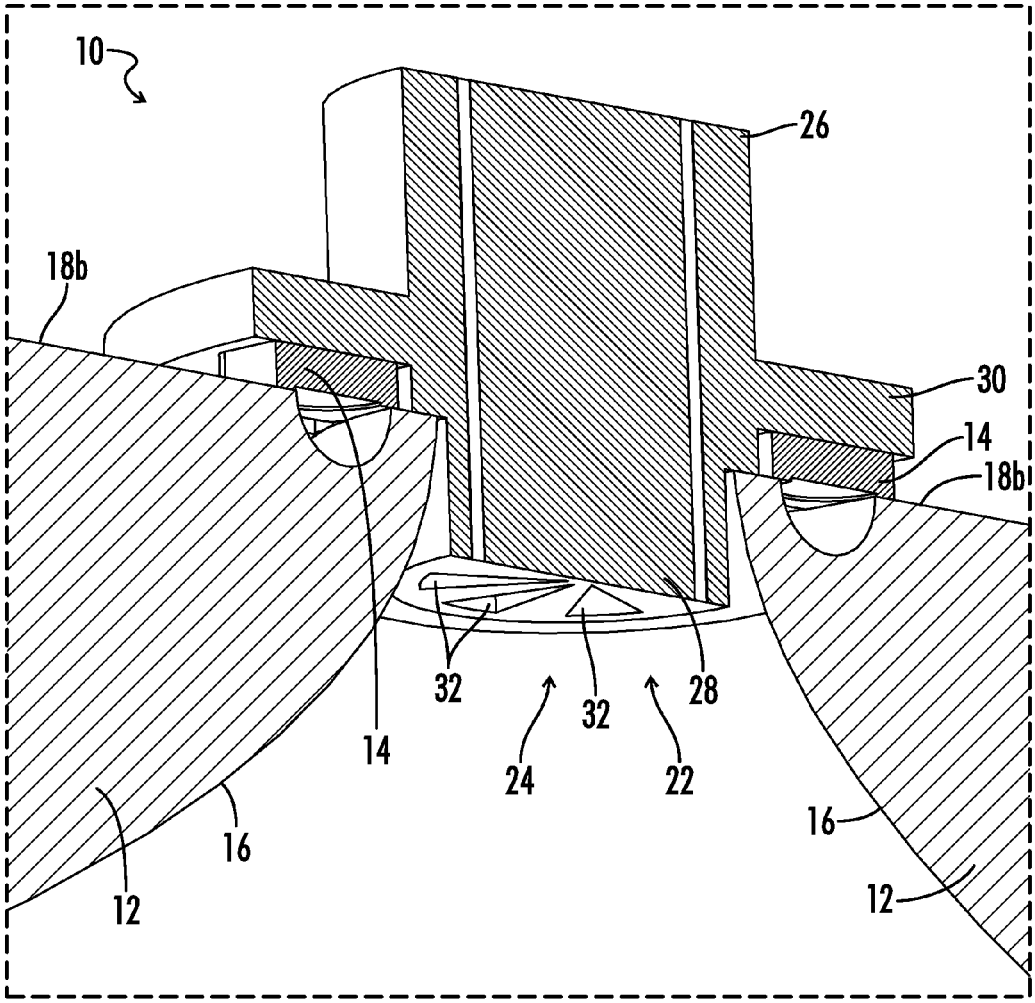
FIG. 3 is a detailed cross-sectional view of a heat spreader insert of the lighting apparatus of FIG. 1.

A detailed view of the heat spreader 26 can be seen in FIG. 3. The heat spreader 26 can cover or be located over the central opening 22, such that the heat spreader 26 is positioned directly in the convective path 24. The heat spreader 26 in some embodiments can include an insert 28 that extends into the central opening 22, and a flange 30 that can connect to the lighting apparatus 10. In FIG. 3, the flange 30 is in contact with both the light source 14 and the lens body 12.

The heat spreader 26 can include at least one through-hole 32. The through-hole 32 can be substantially aligned with the convective path 24, such that air moving along the convective path 24 passes through the heat spreader 26, thereby increasing thermal convection between the heat spreader 26 and the ambient air. In some embodiments, the heat spreader 26 can include a plurality of through-holes 32 to help increase the amount of surface area on the heat spreader 26 that is in contact with the ambient air as well as the air passing through the heat spreader 26 along the convective path 24. Such a configuration can help increase thermal convection and radiation between the heat spreader 26 and the ambient air such that the thermal performance of the lighting apparatus can be further enhanced.

Figure 4:
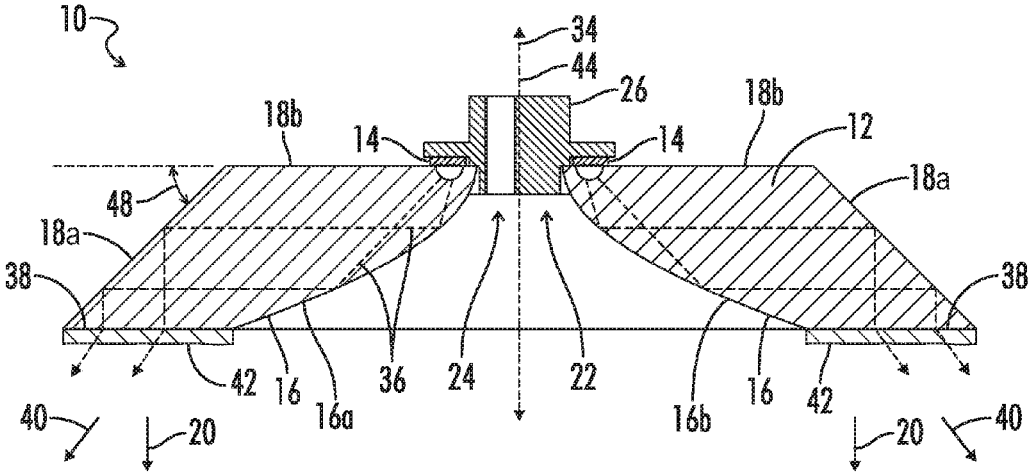
FIG. 4 is a front elevation cross-sectional view of the lighting apparatus of FIG. 1.

Referring now to FIG. 4, in some embodiments the lighting apparatus can include a central axis 34. The central axis 34 can generally define a rotational axis of symmetry for the apparatus 10. In some embodiments, the primary optical surface 16, the secondary optical surface 18, or both, can be radially symmetric about the central axis 34, as shown in FIG. 4. In some embodiments, the central opening 22 can be located on the central axis 34, and the primary optical surface 16 and the secondary optical surface 18 can be offset from the central axis 34, thus allowing air to flow through the central opening 22 and through the apparatus 10. In some embodiments, the primary optical surface 16, the secondary optical surface 18, or both, can be substantially symmetric about both the central axis 34 and the central opening 22.

In some embodiments, the primary optical surface 16 can be shaped as an off-axis parabola, or a portion of a parabola that does not include the vertex of the parabola. The first portion 18*a* of the secondary optical surface 18 can form an angle 48 with the second portion 18*b* of the secondary optical surface 18 between about 20 degrees and about 70 degrees. In other embodiments, the angle 48 formed between the first portion 18*a* and the second portion 18*b* can be between about 35 degrees and about 55 degrees. In other embodiments, the angle formed between the first portion 18*a* and the second portion 18*b* can be about 45 degrees. Such an embodiment can show about a 93 percent optical efficiency without having a "lit-appearance" uniformity penalty.

In some embodiments, as shown in FIG. 4, the light source 14 can include two or more light emitting diodes, the light emitting diodes also being offset and positioned substantially symmetrically about the central axis 34. In some embodiments the two or more light emitting diodes 14 can also be positioned substantially symmetrically about the central opening 22. The heat spreader 26 in some embodiments can be aligned coaxially with the central axis 34 of the lighting apparatus 10. As such, air passing through the heat spreader 26 can flow along the convective path 24 in a direction substantially parallel to the central axis 34.

As can be seen in FIG. 4, light 36 can be emitted from the light source 14 and be directed towards the primary optical surface 16. The primary optical surface 16 can then redirect the light 36 towards the second optical surface 18. The second optical surface 18 can then further redirect the light in a primary emission direction 20. The primary emission direction 20 denotes the general direction in which light 36 is redirected by the secondary optical surface 18, when the light 36 is observed collectively. It is not a requirement that all individual rays of light 36 be redirected by the second optical surface 18 in a collimated fashion such that all the light is redirected in a substantially parallel orientation or uniform direction. However, in some embodiments, the primary and secondary optical surfaces 16 and 18 can be configured such that the light 36 can be redirected by the second optical surface 18 in a collimated or substantially parallel fashion.

In some embodiments, once the light 36 has been redirected by the second optical surface 18, the light 36 then exits or is emitted from the lighting apparatus 10. In other embodiments, the lighting apparatus 10 can further include a third optical surface 38. The third optical surface 38 can be oriented substantially transverse to the primary emission direction 20. The third optical surface 38 can be configured to receive redirected light 36 from the secondary optical surface 18. The third optical surface 38 can then further redirect the light 36 in a secondary emission direction 40. The secondary emission direction 40 can be designed for depending on the desired distribution of the lighting apparatus 10. The angle or orientation of the third optical surface 38 can be varied in order to produce a distribution of light in a desired secondary emission direction 40. The third optical surface 38 in some embodiments can be angled or configured to increase the beam angle of the light 36 being emitted from the lighting apparatus 10. Increasing the beam angle of the light distribution can allow a larger area to be lit by the lighting apparatus 10. In other embodiments, the third optical surface 38 can be configured to produce an asymmetric light distribution, or a geometrically patterned light distribution.

In some embodiments, as shown in FIG. 4, the lighting apparatus 10 can further include an optical window 42. The optical window 42 can be configured such that substantially all light 36 being emitted by the lighting apparatus 10 passes through the optical window 42. The optical window 42 can include diffusers, micro lenses, micro prisms, Fresnel patterns, kinoforms, or other surface characteristics. The optical window 42 can help scatter or disperse the light 36 exiting the lighting apparatus 10 in order to produce a unique or different lit appearance.

In the embodiments shown in FIG. 1-4, the lighting apparatus 10 includes a lens body 12. The primary and secondary optical surfaces 16, 18 may be located on or be a part of the lens body 12. As such, light 36 being emitted by the light source 14 travels through the lens body 12 until it exits the lighting apparatus 10. In other embodiments, the primary and secondary optical surfaces can be two separate structures that define an open space in which light travels before exiting the lighting apparatus 10.

In either embodiment, the primary optical surface 16 can be specularly reflective. The primary optical surface 16 can be a total internal reflective surface, or the primary optical surface 16 can have a mirror finish such that all light directed at the primary optical surface 36 is reflected towards the secondary optical surface 18. The secondary optical surface 18 in some embodiments can also be specularly reflective. The secondary optical surface 18 can also be a total internal reflective surface, or have a mirror finish such that light directed at the secondary optical surface 18 is reflected by the secondary optical surface 18 out of the lighting apparatus 10.

Figure 11:
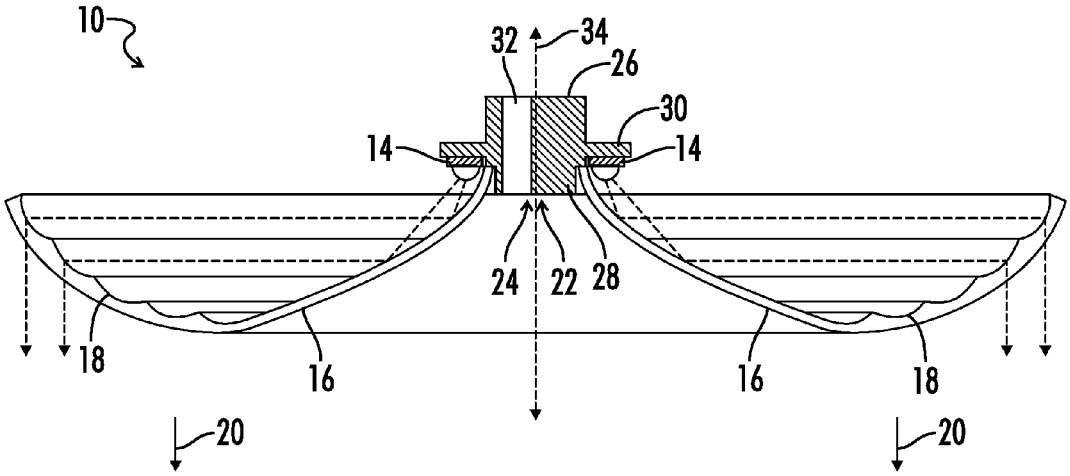
FIG. 11 is a front elevation cross-sectional view of a third embodiment of a lighting apparatus of the present invention.

In some embodiments, as shown in FIG. 11, the secondary optical surface 18 can be a refractive surface such that light 36 being redirected towards the secondary optical surface 18 is not reflected, but passes through the secondary optical surface 18, the light 36 being bent as it passes through the secondary optical surface 18 such that the secondary optical surface 18 redirects the light 36 in a primary emission direction 20. In the embodiment of FIG. 11, the secondary optical surface 18 includes multiple concave lenses which can bend and redirect the light 36 in the primary emission direction 20.

FIG. 4 shows a cross-section view of the embodiment of FIG. 1. In FIG. 1, this cross-section is revolved to produce the lighting apparatus 10. However, in some embodiments, this cross-section can be extruded to form a linear or elongated lighting apparatus. The apparatus can include a midline or central plane 44. The central opening 22 can be located on a midline or central plane 44 and extend through the apparatus 10. The primary optical surface 16 can be substantially symmetric about the midline or central plane 44, and therefore symmetric about the central opening 22. In some embodiments, the secondary optical surface 18 can also be substantially symmetric about the midline or central plane 44 and the central opening 22.

Because an extruded lighting apparatus 10 could have significant length, some embodiments may include multiple central openings 22 to increase the thermal performance along the entire length of the apparatus. The central openings 22 could define one or more convection paths 24 through the lighting apparatus 10. In those embodiments with multiple central openings, the apparatus can further include multiple thermally conductive covers or heat spreaders 26, with a heat spreader 26 covering each central opening 22 and placed in a convective air path 24.

In some embodiments, the primary optical surface 16 can be one integral surface, as seen in the revolved embodiment of FIG. 1. In other elongated embodiments having the cross-section shown in FIG. 4, the primary optical surface 16 further includes a first primary optical surface 16*a* and a second primary optical surface 16*b*. The central opening 22 and the convective path 24 can be defined between the first and second primary optical surfaces 16*a* and 16*b*. In some embodiments, the first and second primary optical surfaces 16*a* and 16*b* can be substantially symmetric about the central opening 22. The first and primary optical surfaces 16*a* and 16*b* can be connected by one or more connection pieces spanning across the central opening 22. In such embodiments, the secondary optical surface 18 can also include two separate pieces in a similar arrangement as the first and second primary optical surfaces 16*a* and 16*b*

Figure 5:
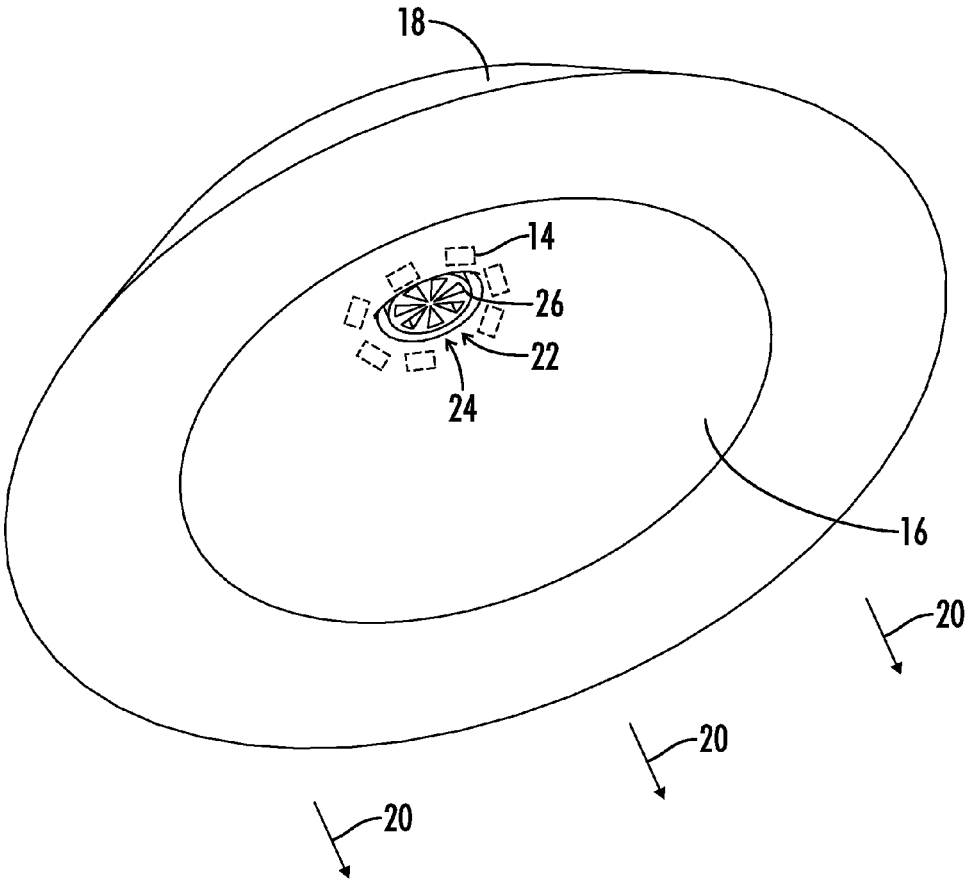
FIG. 5 is a bottom perspective view of the lighting apparatus of FIG. 1.

As can be seen in FIG. 5, in some embodiments of the lighting apparatus 10, the primary optical surface 16 can be oriented to obstruct a direct view of the light source 14 when the apparatus 10 is viewed from along the primary emission direction 24. As such, the apparatus 10 can be an indirect lighting system, such that an observer does not look directly at the light source. Looking directly at a light source 14 can be bright and painful for the eyes of the observer, which can be undesirable. Having the primary optical surface 16 obstruct a direct view of the light source 14 can allow the lighting apparatus 10 to emit a desired amount of light without potentially hurting the observer's eyes.

For the orientation of the lighting apparatus 10 as shown in FIG. 4, the configuration of the light source 14, primary optical surface 16, and secondary optical surface 18 allow the lighting apparatus 10 to be an indirect lighting system having the light source 14 located on a side of the lighting apparatus generally opposite the primary emission direction 20. As such, the heat spreader 26, which can help dissipate heat from the light source 14, can also be located on a side of the lighting apparatus 10 generally opposite the primary emission direction 20.

In many conventional indirect lighting systems, the light source is located in a side of the lighting apparatus generally facing the primary emission direction. The light source emits light generally away from the primary emission direction, and a reflector then redirects the light in the primary emission direction. Heat management systems connected to the light source in these conventional systems are then necessarily located on a side of the lighting apparatus generally facing the primary emission direction. In such a system, when an observer views the apparatus from the primary emission direction, the heat spreader is readily visible, which can produce an aesthetically undesirable appearance. Having the heat spreader 26 on a side of the lighting apparatus 10 generally opposite the primary emission direction 20, as shown in FIG. 4, can help produce a more desirable aesthetic appearance for the lighting apparatus 10.

The primary optical surface 16 in some embodiments can be configured such that all light 36 from the light source 14 is redirected by the primary optical surface 16 towards the secondary optical surface 18. For such embodiments, no light 36 from the light source 14 is emitted from the lighting apparatus 10 without first being redirected by the primary optical surface 16. Accordingly, an observer can be prevented from viewing any direct light 36 from the light source 14 when the apparatus 10 is viewed from any direction.

Figure 6:
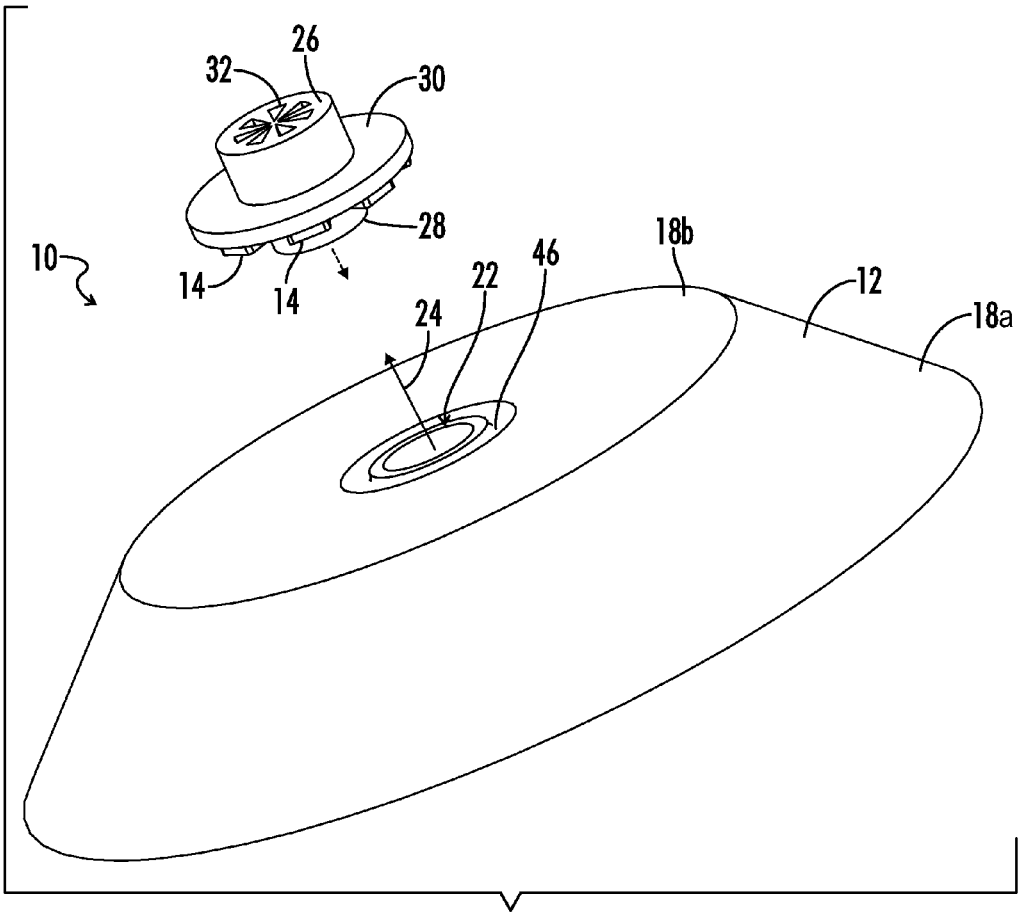
FIG. 6 is a perspective exploded view of the lighting apparatus of FIG. 1.

An exploded view of the lighting apparatus of FIG. 1 is shown in FIG. 6. The lens body 12 can be one continuous revolved piece. The heat spreader 26 can then be positioned or inserted to cover the central opening 22 such that the one or more through-holes 32 are aligned with the convective path 24. The heat spreader insert 28 can be inserted into the central opening 22, such that the heat spreader flange 30 contacts the lens body 12. In some embodiments, the light source 14 can be connected directly to the heat spreader 26. The heat spreader and light source 14 can be manufactured as one insert that can then be connected to the lens body 12. In some embodiments, the lens body 12 can include a circumferential channel 46 surrounding the central opening 22. When the heat spreader 26 is placed in position to cover the central opening 22, the light source 14 can be configured or positioned on the heat spreader 26 to rest in the circumferential channel 46. The light source 14 placed within the circumferential channel 46 can help ensure that the light emitted from the light source 14 passes directly into the lens body 12.

Figure 7:
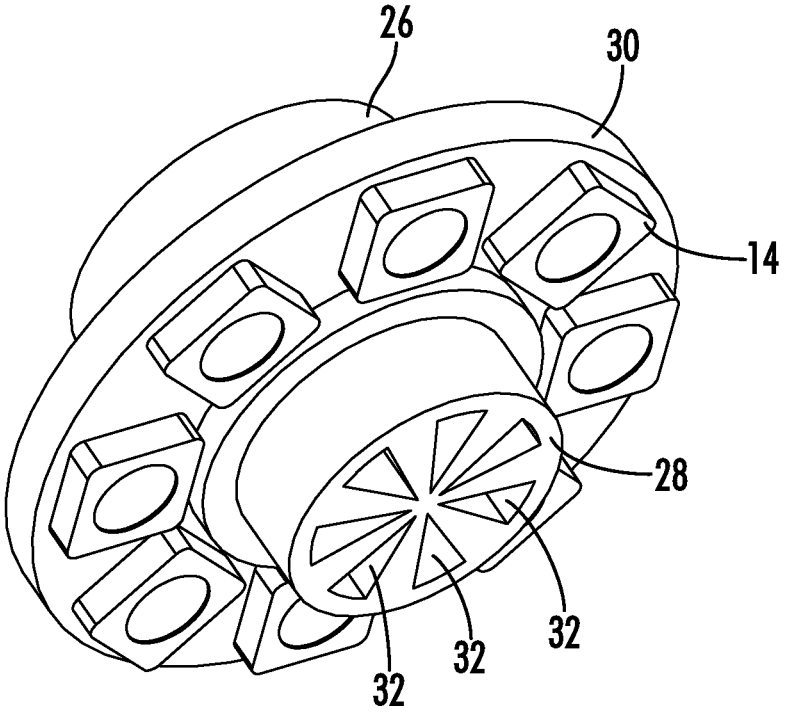
FIG. 7 is a detailed perspective view of the heat spreader of the lighting apparatus of FIG. 1.

A detailed view of an embodiment of the heat spreader 26 can be seen in FIG. 7. In some embodiments, the light source can include multiple light emitting diodes 14 (LEDs). The LEDs in some embodiments can be positioned substantially symmetrically about the central opening 22. In FIG. 7, showing a heat spreader 26 for a revolved embodiment, the LEDs 14 can be radially or rotationally symmetric about the central opening. In an extruded embodiment, the light source 14 can include two rows of LEDs positioned symmetrically about the central opening 22. Symmetrically positioned LEDs 14 can help produce a uniform or consistent light distribution profile from the lighting apparatus 10. Having multiple LEDs 14 can help increase the overall amount of light being emitted by the lighting apparatus 10, or can increase the intensity of the light distribution.

Figure 8:
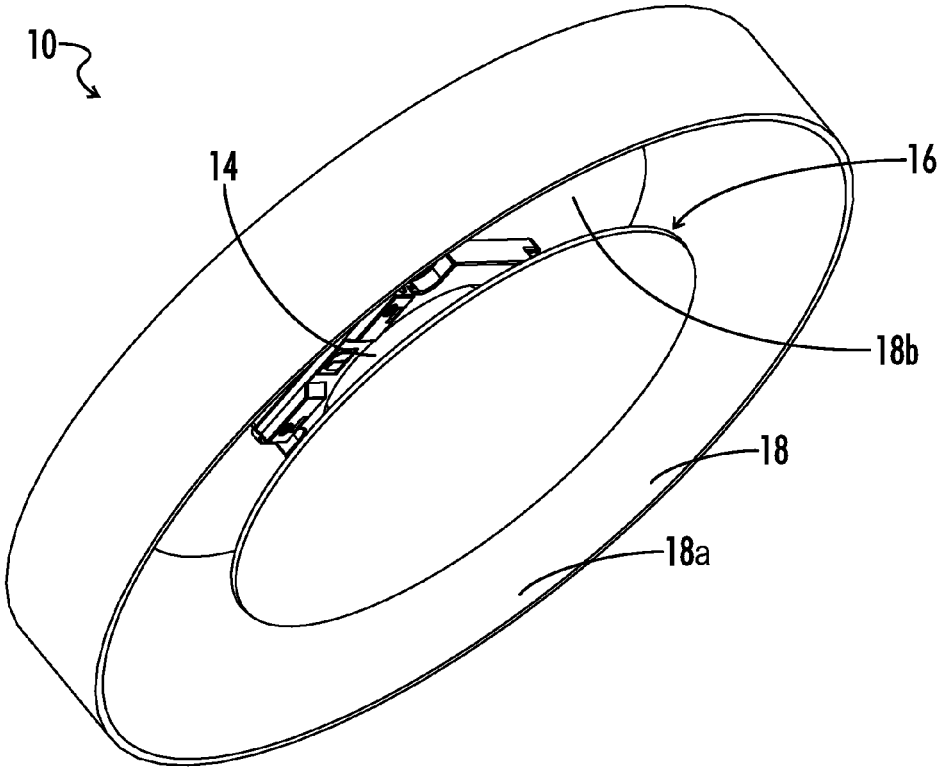
FIG. 8 is a perspective view of another embodiment of a lighting apparatus according to the present invention.

A second embodiment of a lighting apparatus 10 of the present invention is shown in FIG. 8. The apparatus 10 again includes a light source 14, a primary optical surface 16, and a secondary optical surface 18. However, the embodiment of FIG. 8 does not include a lens body 12. The optical surfaces 16 and 18 are spaced apart such that light emitted by the light source 14 passes through air as it is being redirected by the primary and secondary optical surfaces 16 and 18. As such, air can be circulated between the primary and secondary optical surfaces 16 and 18, as well as around the light source 14, to provide improved thermal performance.

Figure 9:
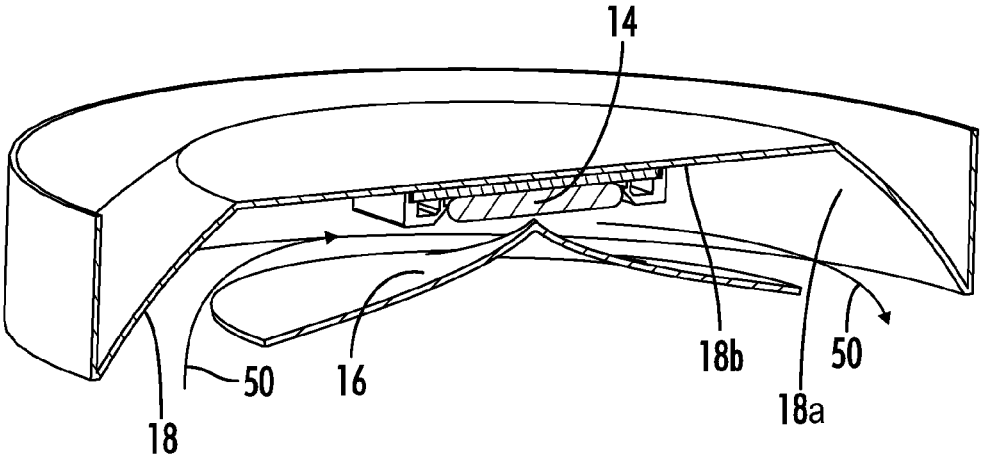
FIG. 9 is a perspective cross-sectional view of the lighting apparatus of FIG. 8.

A cross-section view of the embodiment of FIG. 8 is shown in FIG. 9. The interior convective path 50 is shown between the primary optical surface 16 and the secondary optical surface 18 such that air can pass over both surfaces. Additionally, air can flow around the light source 14. As such, the primary optical surface 16, the secondary optical surface 18, and the light source 14 can allow heat transfer to the ambient air through convection as well as radiation, thereby helping to improve the thermal performance of the lighting apparatus 10.

Figure 10:
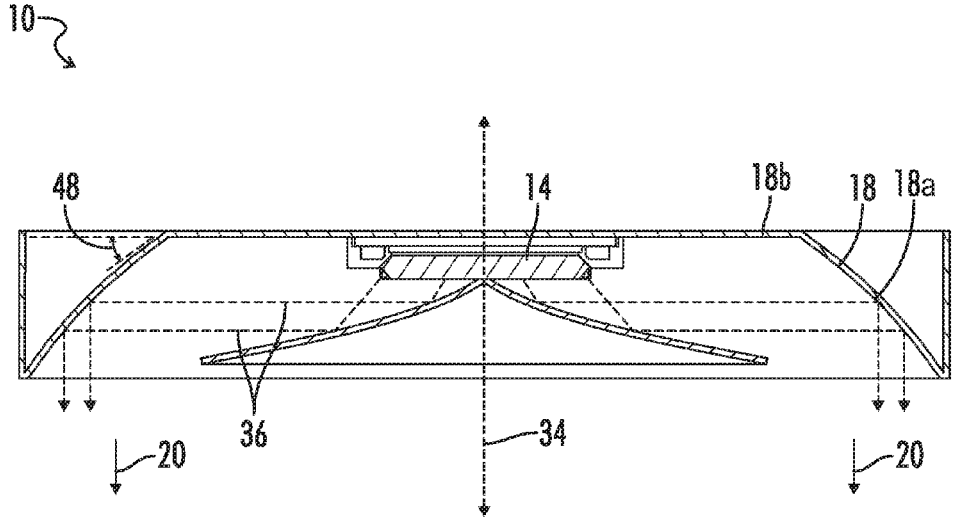
FIG. 10 is a front elevation cross-sectional view of the lighting apparatus of FIG. 9.

A front elevation cross-sectional view of the embodiment seen in FIG. 8 is shown in FIG. 10. The primary optical surface 16 can again be an off axis parabola in some embodiments. The secondary optical surface can have a first portion 18*a* and a second portion 18*b*. The first portion 18*a* in FIG. 10 can be slightly rounded. However, the slightly rounded first portion 18*a* can still generally form an angle 48 with the second portion 18*b* similar to the angle described for FIG. 4. As such, the second embodiment can achieve the same optical efficiency.

The primary optical surface 16 can be configured to receive light from the light source 14 and redirect it towards the secondary optical surface 18. The secondary optical surface 18 subsequently redirects the light in a primary emission direction 20 out of the lighting apparatus 10. The primary optical surface 16 can be positioned to obstruct a direct view of the light source 14 when the lighting apparatus is viewed from the primary emission direction 20. The light source 14 can also emit light in a generally conical pattern in some embodiments such that all light from the light source 14 is reflected by the primary optical surface 16. As such, no direct light is seen by an observer when viewing the lighting apparatus from any direction. In some embodiments, the primary and secondary optical surfaces 16 and 18 can be substantially rotationally symmetric about a central axis 24.

Thus, although there have been described particular embodiments of the present invention of a new and useful Compact Indirect Lighting System with Improved Thermal Performance it is not intended that such references be construed as limitations upon the scope of this invention except as set forth in the following claims.

What is claimed is:

1. A lighting apparatus comprising:

a light source comprising a plurality of light emitting devices, the light sources emitting light in a first range of directions;

a primary optical surface configured to receive light emitted from the light emitting devices of the light source and to reflectively redirect the light in a second range of directions;

a secondary optical surface configured to receive the reflectively redirected light from the primary optical surface and to reflectively redirect the light in a primary emission direction, the primary emission direction being within the first range of directions;

a central opening through the apparatus, the central opening having a boundary and defining a convective path within the boundary; and a heat spreader positioned in the central opening, the plurality of light emitting devices mounted to the heat spreader outside the boundary of the central opening, the light emitting devices thermally coupled to the heat spreader, the heat spreader having at least one through-hole that allows air flow through the heat spreader.

2. The apparatus of claim 1, further comprising a central axis, the central opening located on the central axis, wherein the primary optical surface and the secondary optical surface are offset from the central axis.

3. The apparatus of claim 2, wherein the primary optical surface and the secondary optical surface are substantially rotationally symmetric about the central axis.

4. The apparatus of claim 1, wherein the primary optical surface further comprises a first primary optical surface and a second primary optical surface, the central opening and the convective path being defined between the first and second primary optical surfaces.

5. The apparatus of claim 1, wherein the primary optical surface is an off-axis parabolic surface.

6. The apparatus of claim 1, wherein the primary optical surface is a specular reflective surface.

7. The apparatus of claim 1, wherein the secondary optical surface is a specular reflective surface.

8. The apparatus of claim 1, wherein the primary optical surface is oriented to obstruct a direct view of the light source when the apparatus is viewed along the primary emission direction.

9. The apparatus of claim 1, wherein the primary optical surface is configured to redirect substantially all light emitted from the light source towards the secondary optical surface.

10. The apparatus of claim 1, further including a third optical surface oriented substantially transverse to the primary emission direction, the third optical surface configured to receive light redirected by the secondary optical surface, the third optical surface further redirecting the light in a secondary emission direction.

11. The apparatus of claim 1, further comprising an optical window configured such that substantially all light exiting the apparatus passes through the window, wherein the window comprises at least one of a diffuser, micro lens, micro prism, Fresnel pattern, or kinoform.

12. The apparatus of claim 1, further comprising a lens body, the primary optical surface and the secondary optical surface located on the lens body, the central opening extending through the lens body.

13. The apparatus of claim 1, wherein the light emitting devices of the light source comprise two or more light emitting diodes positioned substantially symmetric about the central opening.

14. A lighting apparatus comprising:

a light source comprising a plurality of light emitting devices, the light sources emitting light in a first range of directions;

a primary optical surface configured to receive light emitted by the light emitting devices of the light source and to reflectively redirect the light in a second range of directions;

a secondary optical surface configured to receive the reflectively redirected light from the primary optical surface and to reflectively redirect the light in a primary emission direction, the primary emission direction being within the first range of directions;

a central opening defined through the apparatus, the primary and secondary optical surfaces substantially symmetric about the central opening, the central opening having a boundary; and a heat spreader positioned in the central opening, the plurality of light emitting devices mounted to the heat spreader outside the boundary of the central opening, the light emitting devices thermally coupled to the heat spreader, the heat spreader having at least one through-hole that allows air flow through the heat spreader.

15. The apparatus of claim 14, further comprising a central axis, wherein the central opening is located on the central axis, and the primary and secondary optical surfaces are substantially rotationally symmetric about the central axis.

16. The apparatus of claim 14, wherein the primary optical surface is an off-axis parabolic surface.

17. The apparatus of claim 14, wherein the central opening defines a convective path through the apparatus.

18. A lighting apparatus comprising:

a light source comprising a plurality of light emitting devices, the light sources emitting light in a first range of directions;

a primary optical surface configured to receive light emitted from the light emitting devices of the light source and to reflectively redirect the light in a second range of directions;

a secondary optical surface configured to receive the reflectively redirected light from the primary optical surface and to reflectively redirect the light in a primary emission direction, the primary emission direction being within the first range of directions;

a central opening through the apparatus, the central opening having a boundary, the central opening defining a convective path within the boundary; and a thermally conductive cover positioned over and in the central opening and positioned in the convective air path, the thermally conductive cover having an outer portion extending outside the boundary of the central opening, the plurality of light emitting devices mounted to the outer portion of the thermally conductive cover and thermally coupled to the thermally conductive cover, the thermally conductive cover having at least one through-hole that allows air flow through the thermally conductive cover.

19. The apparatus of claim 18, wherein the thermally conductive cover comprises a heat spreader in contact with the light emitting devices of the light source, and the through-hole is substantially aligned with the convective path.

* * * * *